US010619430B2

(12) United States Patent
Schaipp et al.

(10) Patent No.: US 10,619,430 B2
(45) Date of Patent: Apr. 14, 2020

(54) DRILLING DEVICE AND METHOD FOR SCREWING DRILL ROD ELEMENTS TO A DRILLING DEVICE

(71) Applicant: PRAKLA Bohrtechnik GmbH, Peine (DE)

(72) Inventors: Stephan Schaipp, Schrobenhausen (DE); Rudolf Wolf, Neuss (DE)

(73) Assignee: PRAKLA Bohrtechnik GmbH, Peine (DE)

( * ) Notice: Subject to any disclaimer, the term of this patent is extended or adjusted under 35 U.S.C. 154(b) by 19 days.

(21) Appl. No.: 15/970,501

(22) Filed: May 3, 2018

(65) Prior Publication Data

US 2018/0334864 A1 Nov. 22, 2018

(30) Foreign Application Priority Data

May 18, 2017 (EP) ..... 17171659

(51) Int. Cl.

| | |
|---|---|
| ***E21B 19/16*** | (2006.01) |
| ***E21B 19/18*** | (2006.01) |
| ***E21B 19/20*** | (2006.01) |
| ***E21B 7/02*** | (2006.01) |
| ***E21B 44/08*** | (2006.01) |
| *E21B 15/04* | (2006.01) |

(52) U.S. Cl.

CPC ..... *E21B 19/165* (2013.01); *E21B 7/022* (2013.01); *E21B 44/08* (2013.01); *E21B 15/045* (2013.01)

(58) Field of Classification Search

CPC ..... E21B 19/16; E21B 19/164; E21B 19/165; E21B 19/18; E21B 19/20

See application file for complete search history.

(56) References Cited

U.S. PATENT DOCUMENTS 5,321,506 A 6/1994 Sargent
5,365,674 A 11/1994 Etchegoyhen et al.
(Continued)

FOREIGN PATENT DOCUMENTS

DE 20 2013 001 608 U1 3/2013
WO 2013/081467 A1 6/2013

OTHER PUBLICATIONS

European Search Report issued by the European Patent Office dated Nov. 2, 2017, which corresponds to European Patent Application No. 17 17 1659.

*Primary Examiner* — Cathleen R Hutchins

(74) *Attorney, Agent, or Firm* — Studebaker & Brackett PC

(57) ABSTRACT

A drilling device having a drill drive, a positioning means, a receiving part, a clamping means, and a control unit. The receiving part holds a first drill rod element with a first thread region. The clamping means is positioned on the drill drive for holding at least a second drill rod element having a second thread region. The control unit actuates the drill drive and the positioning means to screw the first and second thread regions together. A distance measuring means detects an adjustment distance of the drill drive along a guide as an actual value. The control unit determines an adjustment distance as a nominal value from a detected revolution speed of the drill drive during screwing and a predetermined thread constant. The control unit determines a difference from the nominal and actual values, and uses the difference to adjust the drill drive and/or the positioning means.

11 Claims, 1 Drawing Sheet

(56) References Cited

U.S. PATENT DOCUMENTS

Figure 1:
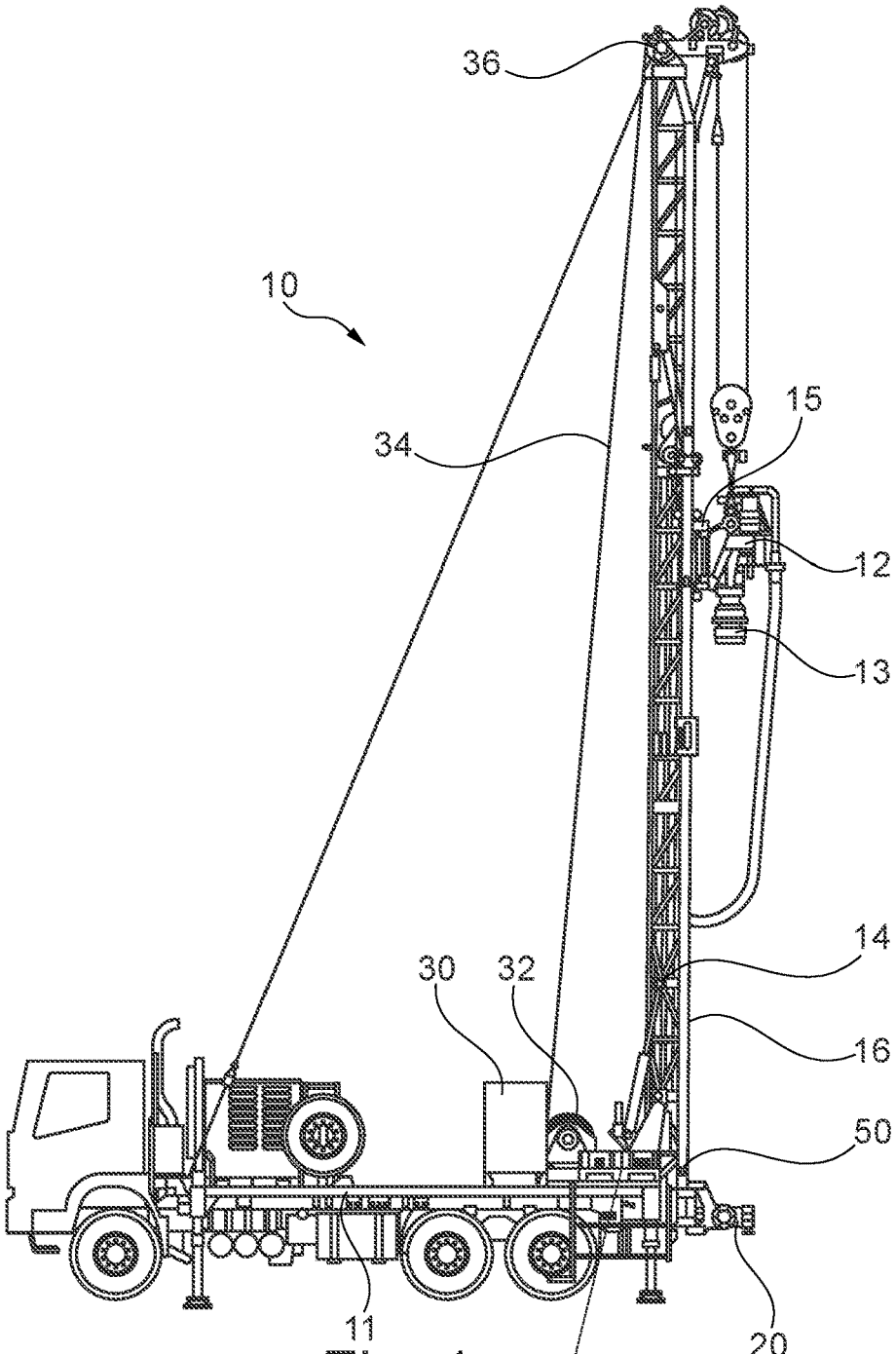

| | | | | |
|---|---|---|---|---|
| 6,155,357 | A | 12/2000 | King et al. | |
| 6,186,248 | B1 | 2/2001 | Silay et al. | |
| 2002/0170720 | A1* | 11/2002 | Haugen | E21B 19/00 166/379 |
| 2008/0093088 | A1 | 4/2008 | Hopwood et al. | |
| 2008/0125876 | A1* | 5/2008 | Boutwell | E21B 19/16 700/21 |
| 2014/0116687 | A1* | 5/2014 | Ruehmann | E21B 19/165 166/250.01 |
| 2016/0060982 | A1* | 3/2016 | Layden | E21B 19/16 166/380 |

* cited by examiner

DRILLING DEVICE AND METHOD FOR SCREWING DRILL ROD ELEMENTS TO A DRILLING DEVICE

The invention relates to a drilling device having a drive which is designed for driving drill rod elements in a rotating manner and is linearly adjustable along a guide, in particular a mast, a positioning means for linear adjustment of the drill drive, a receiving part for receiving and holding at least a first drill rod element with a first thread region, a clamping means which is arranged on the drill drive for holding at least a second drill rod element with a second thread region which can be screwed so as to fit to the first thread region, and a control unit, by which the drill drive and the positioning means can be actuated in order to screw together the first thread region and the second thread region.

The invention further relates to a method for screwing drill rod elements to a drilling device, having a drill drive which drives drill rod elements in a rotating manner and is displaced linearly along a guide, in particular a mast, a positioning means for linear adjustment of the drill drive, a receiving part which receives and holds at least a first drill rod element with a first thread region, a clamping means which is arranged on the drill drive and holds at least a second drill rod element with a second thread region, wherein, for screwing, the second drill rod element is rotated by the drill drive, and a control unit, by which the drill drive and the positioning means are actuated in a controlled manner, wherein the first thread region and the second thread region are screwed together.

To produce drillings with a greater drilling depth it is necessary for the drill rod to be composed of several drill rod elements. The length of one drill rod element approximately corresponds to the height of a mast of the drilling device. By means of a drill drive a first drill rod element is initially clamped and introduced in a rotating manner into the ground. Subsequently, the drill drive, which can also be referred to as a rotary drive head, is reset and provided with a new drill rod element. This has a thread region on its underside which can be screwed so as to fit into a matching thread region at the end of the drill rod element already drilled down. Afterwards, a further drilling step can be carried out. When producing e.g. a water, gas or oil drilling with relatively great drilling depths it may be necessary to compose a plurality of drill rod elements in this way. Conversely, on completion of drilling the drill rod elements can also be withdrawn again from the ground and the screw connections can be released.

When joining two drill rod elements by way of screwing the drill drive produces the rotational movement for the screwing process. At the same time the drill drive must be tracked accordingly in the axial direction. From US 2008/0093088 A1 it is known that a feed movement of the drill drive during screwing is determined depending on the rotational speed and a thread pitch. However, when screwing together drill rod elements it is not always evident when the screw thread engages. For instance at the beginning of a screwing movement idle rotations can occur, during which the two opposite thread regions have not yet engaged and therefore no axial movement takes place. If the drill drive is displaced axially as early as during the idle rotations this can lead to excessive loads on the thread turns and to increased frictional wear as well as an increased force required for screwing. Corresponding loads also occur if threads engage prematurely so that the drill drive lags behind the actual screwing movement.

To avoid excessive loads US 2008/0093088 A1 teaches the provision of a rope suspension of the drill rod with the drill drive and the measurement of the suspended load. If predetermined limit loads are exceeded the rotational speed of the drill drive is changed accordingly until the limit load is underrun again. For practical operation, in which drill rod elements with dirty thread regions are present or deformed thread regions occur in the case of used drill rod elements, the limit loads must be set relatively high. Consequently, also in these known automatic screwing methods the loads and stresses of the threads are relatively high. This results in increased wear and a reduced service life of the drill rod elements.

A similar method and a device for the automatic screwing of drill rod elements can be taken from WO 2013/081467 A1. In this known method, too, an axial weight force and therefore an axial load is detected and used to control the screwing movement.

Furthermore, from U.S. Pat. No. 5,321,506 a method for the pre-installation of drill rod elements is known, in which a threaded sleeve is screwed onto a thread region of a drill rod element. However, the screwing movement is not carried out on a drilling device but in an assembly device in a horizontal position. In doing so, a position measurement can be effected by making use of a camera and a video processor.

The invention is based on the object to provide a drilling device and a method for screwing together drill rod elements, with which a screw connection between drill rod elements can be established or released in an efficient and particularly gentle manner.

The drilling device according to the invention is characterized in that a distance measuring means is provided, by which an adjustment distance of the drill drive along a guide can be detected as an actual value, in that by the control unit a revolution speed of the drill drive during screwing can be detected and, on taking account of a predetermined thread constant, an adjustment distance can be determined as a nominal value, in that by the control unit a comparison of nominal value and actual value can be carried out and a difference value can be determined and in that the drill drive and/or the positioning means can be adjusted by the control unit according to the difference value determined.

A basic idea of the invention resides in the fact that control of a screwing movement is carried out on the basis of an adjustment distance during screwing. On the one hand, a theoretical adjustment distance is determined depending on the revolution speed of the drill drive, i.e. in particular the number of revolutions during screwing, and a predetermined thread constant. In this way, it is possible to determine which theoretical adjustment distance the drill drive has to cover in order to precisely follow the axial feed motion during screwing. This calculated adjustment distance is stored as a nominal value in a control unit. At the same time, the actual displacement distance of the drill drive during screwing is detected as an actual value by a distance measuring means. In the control unit a comparison of nominal value and actual value is carried out, with a difference value resulting therefrom as the case may be. Depending on this difference value a resetting of the drill drive and/or the positioning means can be effected until the actual value is approximate to the nominal value or corresponds to it.

In this way, a gentle screwing, i.e. an establishment or release of a screw connection, can be achieved without the exertion of excessive axial forces onto the delicate thread turns of the thread regions of the drill rod elements. As a result, frictional wear is reduced, damage is prevented and the service life of the drill rod elements is increased. All in all, a gentle and energy-saving operation of the drilling device during screwing is achieved in addition.

The drilling device can be a stationary drilling rig or a mobile drilling apparatus on a carrier vehicle.

Basically, as positioning means for displacement of the drill drive any suitable means can be used, such as chain or spindle drives. According to an embodiment of the invention it is particularly preferred that the positioning means has at least one positioning cylinder and/or a rope winch. The one or several positioning cylinders can be hydraulic cylinders in particular which are arranged on the mast for displacement of the drill drive.

An advantageous further development of the invention resides in the fact that the thread constant comprises a thread pitch or a lead. By way of such a thread value it can be determined which axial shift results from a single revolution. Depending on the revolution speed or the rotational speed in a given time interval an axial adjustment distance can thus be calculated readily.

An advantageous variant of the drilling device according to the invention resides in the fact that the control unit has an input station for the input of data, in particular the thread constants. The input station can have a customary man-machine-interface, in particular an input terminal or a touch screen.

It is especially advantageous for the input station to have a display, on which possible thread constants can be shown. The thread types and thread sizes customary for drill rods can be stored in the control unit in a suitable data store. These options can be shown on the display so that an operator only has to make a choice with regard to the possible thread constants.

Another preferred embodiment of the invention can be seen in the fact that a means for automatic detection of the thread constants is provided. For this purpose, provision can be made e.g. on the drill rod element for a query-based data store, such as an RFID-chip, which is read out by a corresponding querying means on the drilling device. Alternatively or additionally, provision can also be made for a camera system that detects a thread region and determines the related thread constant.

By way of the input station any other data, for instance operating data such as feed motion and drilling speed etc., can also be entered.

Moreover, it is basically possible that the drilling device also has an overload protection during screwing, in which case an axial load is detected on the drill drive or the positioning means. If the limit load is exceeded the screwing process can be slowed down or preferably be terminated. Thus, the detection of a load represents a safety measure which is, however, not used for the regulation of the screwing process.

The method according to the invention is characterized in that a distance measuring means is provided, by means of which an adjustment distance of the drill drive along the guide during screwing is detected as an actual value, in that by the control unit a revolution speed of the drill drive during screwing is detected and, on taking account of a predetermined thread constant, an adjustment distance is determined as a nominal value, in that by the control unit the nominal value is compared with the actual value and a difference value is determined and in that the drill drive and/or the positioning means is adjusted by the control unit according to the difference value determined.

The method according to the invention is implemented, in particular, with the previously described drilling device. The advantages described beforehand can be achieved thereby.

A preferred method variant of the invention resides in the fact that a rotational speed, direction of rotation and/or a revolution speed of the drill drive is adjusted until the actual value corresponds to a nominal value. Thus, during regulation of the screwing process the drill drive is substantially controlled and changed in its operation.

According to a further development of the invention alternative or additional provision is made in that the positioning means is displaced linearly along the guide until the actual value corresponds to the nominal value. Thus, by way of the regulation the positioning means, i.e. in particular the hydraulic cylinder or cylinders or a feed winch for the drill drive, is influenced.

Basically, the method can be carried out with different objectives, for instance to accomplish screwing of the drill rods as quickly as possible. As a result, a particularly efficient drilling operation can be realized. According to the invention an advantageous method variant resides in the fact that the drill drive and the positioning means are actuated in a coordinated manner such that on the thread regions little load and/or friction occurs. As a result, an operation can be achieved that is particularly thread-preserving. This saves energy and generally increases the service life of the drill rod elements.

According to a further embodiment of the method pursuant to the invention provision is made in that the screwing comprises an establishment and/or release of a threaded connection between the first thread region and the second thread region. Thus, the method according to the invention can be used both for screwing-together and for unscrewing between the drill rod elements.

Figure 2:
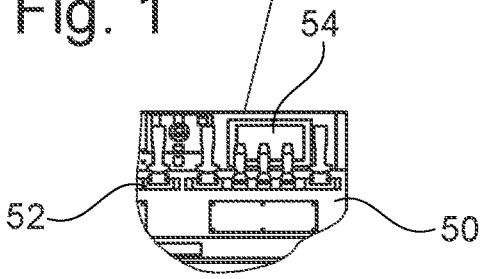

The invention is described further hereinafter by way of a preferred embodiment which is set out further in the following in conjunction with the drawings, wherein show:

FIG. 1 a schematic side view of a drilling device according to the invention and FIG. 2 an enlarged detailed view of an input station of the drilling device of FIG. 1.

According to FIG. 1 a drilling device 10 pursuant to the invention has a carrier vehicle 11, in the rear region of which a vertically erectable mast 14 is provided. On its free side facing away from the carrier vehicle 11 the mast 14 has a linear guide 16, along which a carriage 15 with a drill drive 12 is arranged. By means of a positioning means 30 the carriage 15 can be displaced linearly along the guide 16 of the mast 14. For this purpose, the positioning means 30 has a rope winch 32 for a rope 34. The rope 34 is guided from the rope winch 32 on the carrier vehicle 11 via a deflection pulley 36 at the head of the mast 14 up to the carriage 15.

On a lower end region of the mast 14 a receiving part 20 with a clamping cylinder is provided, by which a first drill rod element, not depicted, partially drilled into the ground, can be held and clamped axially and in a torque-proof manner. Furthermore, on the drill drive 12 a clamping means 13, more particularly a clamping chuck, is provided in a known manner, on which a further second drill rod element is held and clamped in a torque-proof manner on the drill drive 12. On the respective free end regions of the tubular or bar-shaped drill rod elements matching thread regions are provided, with which the drill rod elements can be connected to each other.

To screw together the first and second drill rod elements a control unit 50 is preferably arranged in the rear region of the carrier vehicle 11. The control unit 50 is shown partially enlarged in FIG. 2, wherein it has an input station 52 with a display 54.

Initially, by means of the control unit 50 the drill rod element clamped on the drill drive 12 is displaced downwards until it makes contact with the clamped first drill rod element in the receiving part 20. In doing so, the two opposite thread regions on the drill rod elements are brought into contact. By the control unit 50 the upper second drill rod element is set into rotation, whereby the thread region of the second drill rod element is screwed into the matching thread region of the lower first drill rod element. Depending on a known thread constant, which was entered into the control unit 50 by the operator using the input station 52 or done automatically, the revolution speed of the drill drive 12 during screwing is measured by the control unit and through this an axial adjustment distance of the drill drive 12 is determined by calculation.

At the same time, on the drilling device according to the invention the actual adjustment distance of the drill drive 12 along the guide 16 is measured during screwing as an actual value by a distance measuring means, not depicted in greater detail, which is fixed on the mast 14. In the control unit 50 a comparison of the measured actual value with the nominal value is effected, with a difference value being determined as the case may be. According to a difference value determined the drill drive 12, i.e. in particular a rotational speed or revolution speed of the drill drive 12, or the positioning means 30, in particular the rope winch 32, can be adjusted and thus controlled by the control unit 50. It is clear that the calculation of the nominal value, the detection of the actual value and the determination of the difference value can take place within differentially small time units so that a constant and therefore very precise and also wear-reduced screwing movement can preferably be accomplished. Corresponding control is also carried out when the screw connection between the two thread elements is released.

The invention claimed is:

1. A drilling device having a drill drive configured to drive drill rod elements in a rotating manner and is linearly adjustable along a guide, the guide being a mast, a positioning means for linear adjustment of the drill drive, a receiving part configured to receive and hold at least a first drill rod element with a first thread region, a clamping means configured to hold at least a second drill rod element with a second thread region which can be screwed so as to fit to the first thread region, the clamping means being arranged on the drill drive, and a control unit, by which the drill drive and the positioning means can be actuated in order to screw together the first thread region and the second thread region, wherein a distance measuring means is provided, by which an adjustment distance of the drill drive along the guide can be detected as an actual value, by the control unit a revolution speed of the drill drive during screwing can be detected and, on taking account of a predetermined thread constant, an adjustment distance can be determined as a nominal value, by the control unit a comparison of the nominal value and the actual value can be carried out and a difference value can be determined and the drill drive and/or the positioning means can be adjusted by the control unit according to the difference value determined.

2. The drilling device according to claim 1, wherein the positioning means has at least one positioning cylinder and/or a rope winch.

3. The drilling device according to claim 1, wherein the thread constant comprises a thread pitch or a lead.

4. The drilling device according to claim 1, wherein the control unit has an input station for the input of data, in particular the thread constants.

5. The drilling device according to claim 4, wherein the input station has a display, on which possible thread constants can be shown.

6. The drilling device according to claim 1, wherein a means for automatic detection of the thread constants is provided.

7. A method for screwing drill rod elements with the drilling device according to claim 1, comprising:

driving, using the drill drive, drill rod elements in a rotating manner, the drill drive being displaced linearly along the guide, linearly adjusting the drill drive using a positioning means, receiving and holding, using the receiving part, at least the first drill rod element with the first thread region, holding, using the clamping means, at least the second drill rod element with the second thread region, the clamping means being arranged on the drill drive, wherein, for screwing, the second drill rod element is rotated by the drill drive, and actuating, using the control unit, the drill drive and the positioning means in a controlled manner, wherein the first thread region and the second thread region are screwed together.

8. The method according to claim 7, wherein a rotational speed, a direction of rotation and/or a revolution speed of the drill drive is adjusted until the actual value corresponds to the nominal value.

9. The method according to claim 7, wherein the positioning means is displaced linearly along the guide until the actual value corresponds to the nominal value.

10. The method according to claim 7, wherein the drill drive and the positioning means are actuated in a coordinated manner such that on the first thread region and the second thread region a load and/or friction occurs.

11. The method according to claim 7, wherein the screwing comprises an establishment and/or release of a threaded connection between the first thread region and the second thread region.

* * * * *